US006098674A

United States Patent [19]

Germain et al.

[11] Patent Number: 6,098,674

[45] Date of Patent: Aug. 8, 2000

[54] SOLENOID VALVE AND ITS APPLICATION TO AN APPARATUS FOR DELIVERING CRYOGENIC LIQUID AND A PACKAGING PLANT

[75] Inventors: Jean-Pierre Germain, Montigny Le Bretonneux; Jean-Marie Disdier, Paris, both of France

[73] Assignee: L'Air Liquide, Societe Anonyme pour l'Etude et l'Exploitation des Procedes Georges Claude, Paris, France

[21] Appl. No.: 09/110,969

[22] Filed: Jul. 7, 1998

[30] Foreign Application Priority Data

Jul. 7, 1997 [FR] France ..... 97 08587

[51] Int. Cl.[7] ..... B65B 3/04

[52] U.S. Cl. ..... 141/70; 141/103; 141/183; 137/599

[58] Field of Search ..... 137/238, 594, 137/601; 141/70, 82, 103, 129, 183

[56] References Cited

U.S. PATENT DOCUMENTS

| | | | |
|---|---|---|---|
| 4,244,396 | 1/1981 | Friedland et al. | 137/599 |
| 4,827,988 | 5/1989 | Götz . | |
| 4,880,041 | 11/1989 | Yamada et al. | 141/167 |
| 5,048,564 | 9/1991 | Gaiardo | 137/599 |
| 5,251,424 | 10/1993 | Zenger et al. . | |
| 5,400,601 | 3/1995 | Germain et al. | 62/50.1 |
| 5,566,733 | 10/1996 | Germain . | |

FOREIGN PATENT DOCUMENTS

| | | |
|---|---|---|
| 0331287 | 9/1989 | European Pat. Off. . |
| 0656316 | 6/1995 | European Pat. Off. . |
| 3638601 | 5/1988 | Germany . |

*Primary Examiner*—Henry J. Recla
*Assistant Examiner*—Peter deVore
*Attorney, Agent, or Firm*—Nixon Peabody LLP; Robert M. Schulman

[57] ABSTRACT

A solenoid valve is provided that includes a valve body (14) having an inlet duct (18), an outlet duct (24) and a plurality of sequentially operated solenoid actuators arranged in a circular configuration for selectively bringing these two ducts into communication with each other. The valve body includes at least two separate passages (19, 20) which connect the inlet duct to the outlet duct, and each of the solenoid actuators operates to periodically and selectively close off one of said passages. The solenoid valve finds particular application in inerting and pressurizing bottles containing still liquids with nitrogen.

13 Claims, 3 Drawing Sheets

SOLENOID VALVE AND ITS APPLICATION TO AN APPARATUS FOR DELIVERING CRYOGENIC LIQUID AND A PACKAGING PLANT

BACKGROUND OF THE INVENTION

1. Field of the Invention

The present invention relates to a solenoid valve of the type comprising a valve body provided with an inlet duct, with an outlet duct and with actuating means designed to selectively bring these two ducts into communication with each other. It applies in particular to the inerting/pressurizing of bottles containing a still liquid, for example a fruit juice, with nitrogen.

2. Description of the Related Art

The technique of inerting/pressurizing containers by means of nitrogen consists in delivering to each container moving on a conveyor, after it has been filled, a predetermined dose of liquid nitrogen. Since the container is open, the onset of vaporization of the nitrogen expels the air in contact with the packaged product and then, after sealing the container, the end of vaporization of the nitrogen puts the container under pressure and stiffens it, thereby making it easier to handle subsequently.

In certain cases, for example when these containers are bottles, it is necessary to inject the required dose of liquid nitrogen into each container, which means using a solenoid valve.

Given the rates at which modern packaging lines run, the response time of the solenoid valve must be of the order of a few milliseconds. In addition, the coil of the solenoid valve must not introduce substantial heat into the liquid nitrogen circuit in order to avoid the formation of gas blockages which would interfere with the discharge of the liquid nitrogen doses.

These conditions are all the more critical as an insufficient dose of liquid nitrogen results in the container being poorly inerted and/or insufficiently pressurized, while an excessive dose runs the risk of causing the container to explode.

SUMMARY AND OBJECTS OF THE INVENTION

The object of the invention is to provide a solenoid valve having a very short response time, which is particularly suitable for cryogenic applications, for example in the case of those mentioned above.

For this purpose, the subject of the invention is a solenoid valve of the aforementioned type, characterized in that the valve body comprises at least two separate passages which connect the inlet duct to the outlet duct and in that the actuating means comprise several actuators, each of which is designed to selectively close off one of said passages.

The solenoid valve according to the invention may include one or more of the following characteristics:

- the solenoid valve is furthermore provided with control means designed to open the actuators sequentially and cyclically;
- the inlet duct and the outlet duct are aligned;
- each passage comprises a chamber connected upstream to the inlet duct and downstream to the outlet duct and defining a seat for a closure member of the associated actuator;
- the seat lies between the chamber and the outlet duct;
- the solenoid valve comprises an even number of chambers diametrically opposed in pairs;

- the solenoid valve comprises at least three chambers arranged in a star, and especially in a regular star;
- the actuators have coplanar axes;
- the solenoid valve furthermore comprises an inlet nozzle made of insulating material mounted so as to slide in the inlet duct, and means for elastically stressing the nozzle toward the outside of this duct;
- the entrance of the nozzle has a funnel shape and the solenoid valve furthermore comprises a spherical end-piece designed to be fixed onto the outlet end of a fluid supply pipe;
- the solenoid valve comprises means for injecting a propellant gas at a predetermined point in the outlet duct;
- with the solenoid valve being intended for controlling the dispensing of successive doses of a cryogenic liquid, the valve body is placed in a thermally insulated casing and provided with heating means.

The subjects of the invention are also:

- an apparatus for delivering successive doses of a cryogenic liquid, of the type comprising a dispensing head connected to a source of said liquid, characterized in that the dispensing head comprises a solenoid valve as defined above; and
- a plant for packaging a product in moving containers, characterized in that it comprises an apparatus for delivering successive doses of liquid nitrogen, as defined above, placed above the conveyor for the containers, between a station for filling the containers with the product and a station for sealing the containers, and means for synchronizing the opening of said actuating means with the passage of the containers beneath said apparatus.

BRIEF DESCRIPTION OF THE DRAWINGS

Embodiments of the invention will now be described with regard to the appended drawings in which.

DETAILED DESCRIPTION OF THE PREFERRED EMBODIMENTS

Figure 1:
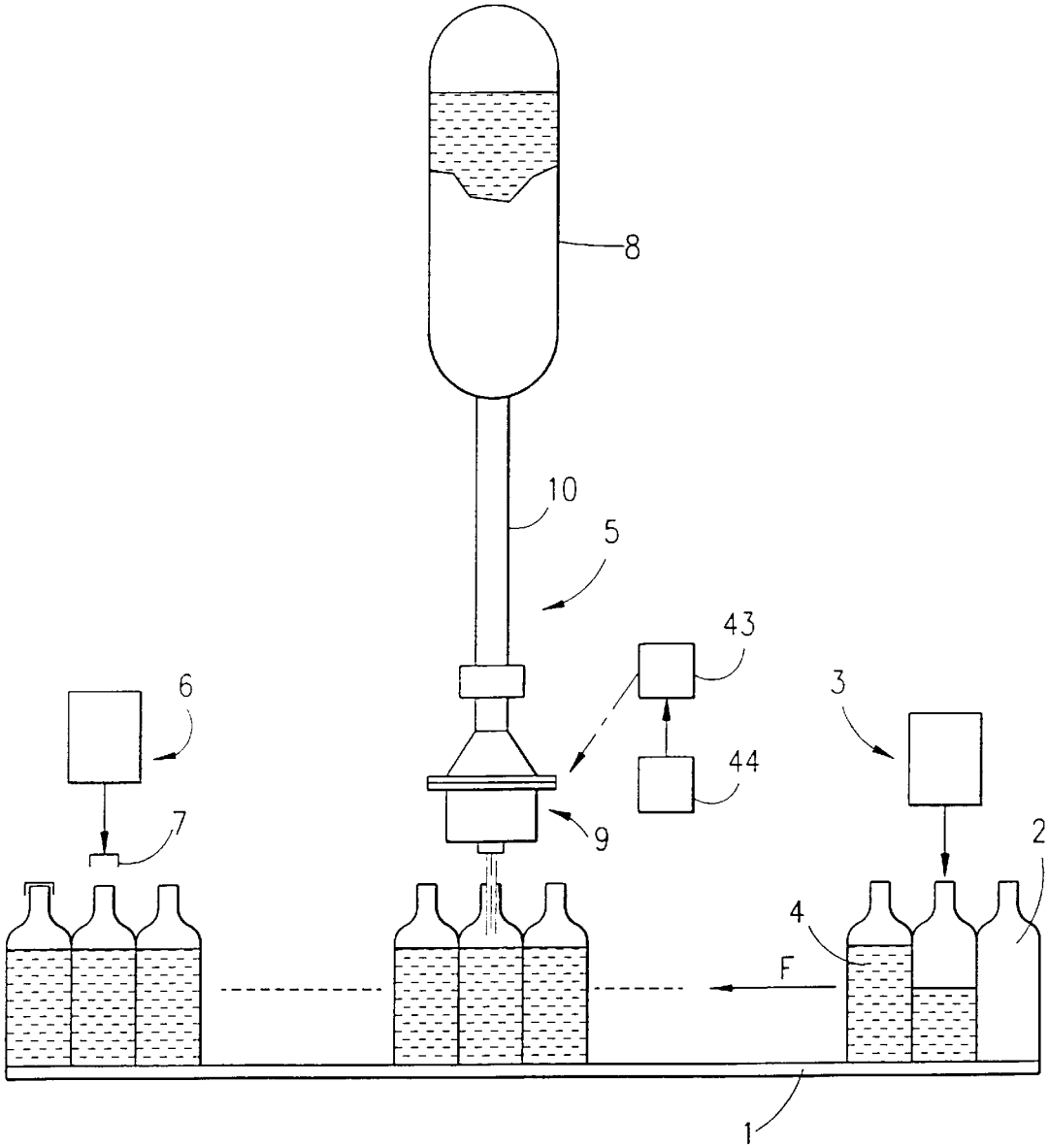
FIG. 1 illustrates diagrammatically a packaging plant according to the invention.
Figure 3:
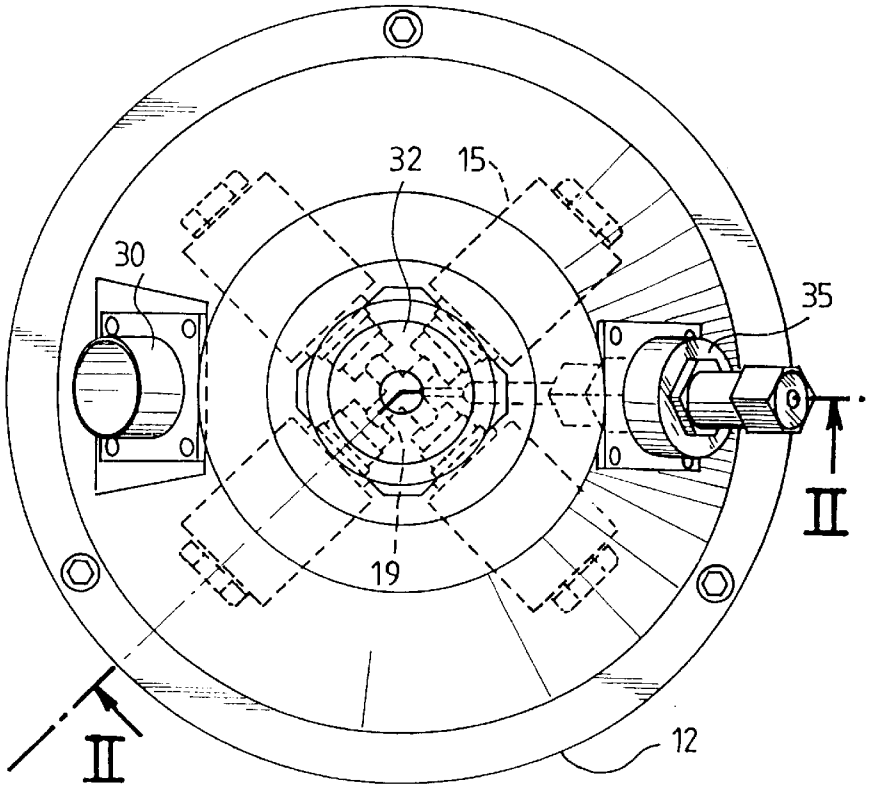
FIG. 3 is a plan view of the solenoid valve.

The packaging plant illustrated in FIG. 1 comprises a conveyor 1 on which bottles 2 move in a single file, in the direction of arrow F. The bottles pass successively beneath a station 3 for filling them with a liquid 4, beneath an apparatus 5 for delivering a dose of liquid nitrogen to each bottle and then beneath a station 6 for sealing the bottles by means of a cap 7.

The apparatus 5 comprises a liquid nitrogen reservoir 8, suitably thermally insulated and equipped with all the conventional accessories for it to be supplied with liquid nitrogen and for it to be vented to the atmosphere, a dispensing head 9 and an evacuated insulated transfer pipe 10 which connects the reservoir to this head. In this example, the pipe 10 is vertical and the reservoir 8 is raised up and possibly pressurized, so that the pipe is gravity-fed.

Figure 2:
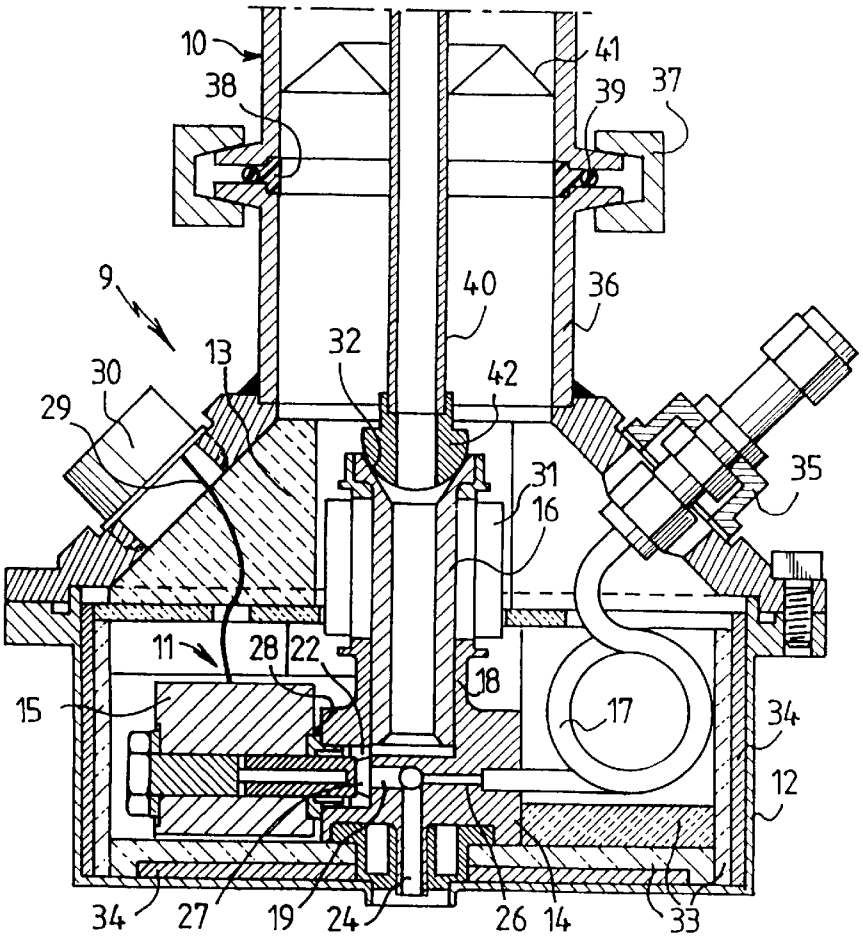
FIG. 2 illustrates, in longitudinal section, the dispensing head of this plant, the section being taken along the broken line II—II in FIG. 3.
Figure 4:
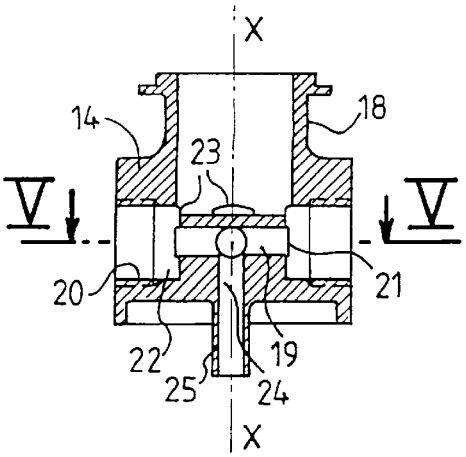
FIG. 4 illustrates, in longitudinal section, along the line IV—IV in FIG. 5, the body of the solenoid valve.
Figure 5:
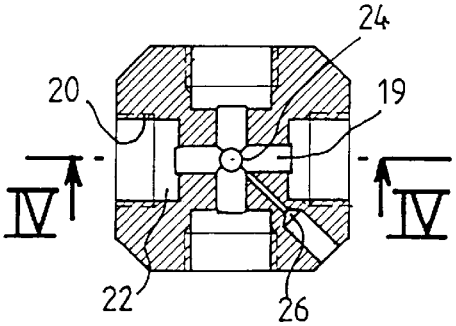
FIG. 5 is a view taken in section along the line V—V in FIG. 4.

The head 9 (FIGS. 2 to 5) comprises a solenoid valve 11 housed in a casing 12. The remaining free space in the latter is filled with a thermal insulation material, part of which has been illustrated at 13 in FIG. 2.

The solenoid valve 11 essentially comprises a valve body 14, four actuators 15, an inlet nozzle 16 and a blowing tube 17.

The body 14 (FIGS. 4 and 5) has the general shape of a parallelepidal unit extended upward by an inlet port 18. The bore of this port terminates about halfway up the unit, this unit being provided with four bores 19 which have coplanar and horizontal axes and are arranged at 90° with respect to each other. The entry of each bore 19 is counterbored at 20 and an annular seat 21 is defined at the bottom of each counterbore.

The port 18 terminates above the bores and communicates via four openings 23 with the chambers 22 defined at the bottom of the counterbores. An outlet duct 24 goes down from the point of intersection of the bores 19 and is defined, in its downstream part, by an outlet port 25 which projects from the body 14. The ports 18 and 25 have a common vertical axis X—X, the internal diameter of the port 25 being very much less than that of the port 16.

The body 14 also has, between two bores 19 and in the same horizontal plane, a narrow duct 26 with a counterbored entrance.

Each actuator 15 is a coil, the core of which carries on the end of it a closure member 27 designed to mate with the corresponding seat 21. The actuator is provided with a threaded end-piece 28 for fixing it in the counterbore 20. The four coils are connected via wires 29 to a connector 30 on the casing 12. While the actuators 15 are illustrated as four actuators 90° apart may be used. In all cases, the actuators are arranged around the cylindrical casing 12 in the form of a regular star, i.e. an equal number of degrees apart.

The inlet nozzle 16 is a tube made of thermally insulating material, namely Teflon, which slides in the port 18. Its flared upper end is upwardly stressed elastically by a metal bellows 31 and has, on the inside, the shape of a funnel 32.

The valve body is wedged in the casing 12 by means of insulating blocks 33 which press against the internal walls of the casing. The lower and peripheral blocks are provided with heaters 34 having a built-in electrical resistance element.

The tube 17, which forms an expansion coil inside the casing, is fitted at its downstream end into the entrance of the bore 26 and at its upstream end into a gas inlet connector 35 provided on the casing.

The casing 12 has a cylindrical shape around the body 14, then converges upward around the nozzle 16 and is then extended upward by a port 36. The latter is connected to the outer tube of the pipe 10 by a clamped flanged fitting 37 with the interposition of a centering ring 38 and a seal 39.

The inner tube 40 of the pipe 10 extends beyond the downstream closure device 41 of the pipe, passes through the port 36 and has, on its end, a stainless steel spherical end-piece 42. Due to the effect of the bellows 31, when the dispensing head 9 is fitted onto the pipe 10, the end-piece 42 is applied, with a reliable linear contact, in the entry funnel 32 of the nozzle 16.

In service, liquid nitrogen is permanently in contact, under a modest overpressure, with the orifices 23 in the valve body. Initially, all the actuators 15 are in the closed position. When the solenoid valve has been cooled right down, control means 43 (FIG. 1) bring the actuators sequentially and cyclically into the open position, this operation being synchronized on the basis of signals provided by sensors 44 which detect the passage of successive bottles 14.

In addition, between two successive opening movements, pressurized gas is sent via the tube 17 and the bore 26 into the entrance of the outlet duct 24, thereby isolating a precise dose of liquid nitrogen equal to the volume of this outlet duct and expels it downward. This propellant gas may, in particular, be gaseous nitrogen at ambient temperature.

Experience has shown that such a dispensing head could have a response time of less than 10 milliseconds and a lifetime of at least 10 million cycles, while still delivering an almost constant quantity of liquid nitrogen at each cycle.

Moreover, in the application in question, the dispensing head consists entirely, throughout the length of the liquid nitrogen circuit, of materials compatible with liquid nitrogen and with the products for cleaning the plant. Thus, in the example described above, the valve body 14 is made of stainless steel, the nozzle 16 is made of Teflon and the closure members are made of "Buna".

In addition, the actuators 15 may consist of low-power (at most 10 W) commercial components in order to limit the heat influx.

It will also be noted that the presence of the heaters 34 in the casing 12 prevent any condensation or ice forming, especially in the region of the liquid nitrogen outlet.

Figure 6:
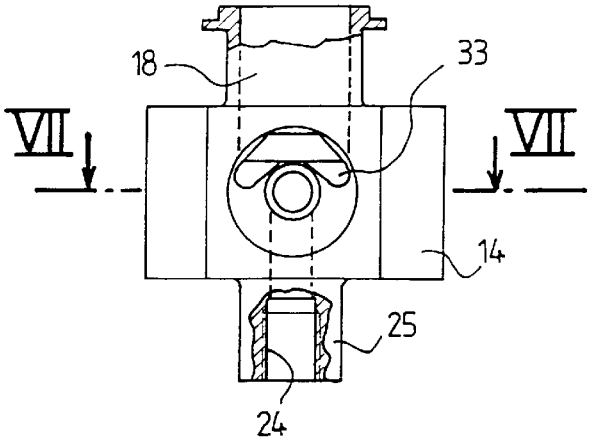
FIG. 6 is an elevation of an alternative embodiment of the body of the solenoid valve.
Figure 7:
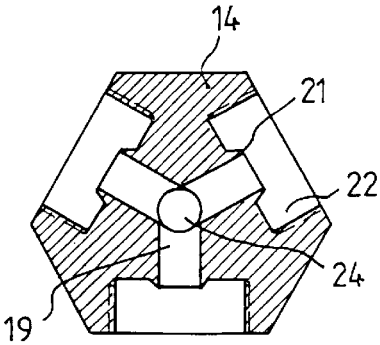
FIG. 7 is a view taken in section along the line VII—VII in FIG. 6.

In order to deliver greater doses of liquid nitrogen, it is possible to use the alternative embodiment of a three-actuator solenoid valve, the body 14 of which is illustrated in FIGS. 6 and 7. The axes of the three actuators are again coplanar and horizontal and they are arranged in a star 120° to each other (FIG. 7). In addition, by milling operations, the areas of the openings 33 have been increased so as to provide a freer permanent passage for the liquid nitrogen from the inlet duct 18 to the chambers 22. These openings 33 are thus in the form of a kidney bean, as may be seen in FIG. 6.

In this embodiment, it will also be seen that the outlet port 24 is internally threaded in order to fit an interchangeable end-piece (not illustrated).

What is claimed is:

1. Solenoid valve for providing uniform doses of a liquid comprising a single valve body:

an inlet duct, a sole outlet duct for conducting said uniform doses of liquid, at least three of actuators designed to selectively bring these two ducts into communication with each other, at least two separate passages which connect the inlet duct to the outlet duct, a blowing mechanism for blowing a propellant gas at a predetermined point in the outlet duct to isolate and expel a dose of liquid, and a controller for sequentially and cyclically actuating the actuators to open and close one of said passages to sequentially collect doses of said liquid in said outlet duct.

2. Solenoid valve according to claim 1, wherein the inlet duct and outlet duct are aligned.

3. Solenoid valve according to claim 1, wherein each passage comprises a chamber connected upstream to the inlet duct and downstream to the outlet duct and defining a seat for a closure member of the associated actuator.

4. Solenoid valve according to claim 3, wherein the seat lies between the chamber and the outlet duct.

5. Solenoid valve according to claim 4 which comprises an even number of chambers (22) diametrically opposed in pairs.

6. Solenoid valve according to claim 5 wherein the actuators have coplanar axes.

7. Solenoid valve according to claim 4 which comprises at least three chambers arranged in a star.

8. Solenoid valve according to claim 7, wherein said at least three chambers are arranged in a regular star.

9. Solenoid valve according to claim 1, further comprising an inlet nozzle made of insulating material mounted so as to slide in the inlet duct and means for elastically stressing the nozzle toward the outside of this duct.

10. Solenoid valve according to claim 9, wherein said inlet nozzle comprises an entrance having a funnel shape and the solenoid valve furthermore comprises a spherical end-piece designed to be fixed onto the outlet end of a fluid supply pipe.

11. Solenoid valve according to claim 1 for controlling the dispensing of successive doses of a cryogenic liquid, wherein the valve body is placed in a thermally insulated casing and provided with a heater.

12. Apparatus for delivering successive doses of a cryogenic liquid comprising a dispensing head connected to a source of said liquid, wherein the dispensing head comprises a solenoid valve according to claim 1.

13. Plant for packaging a product in moving containers on a conveyor comprising an apparatus for delivering successive doses of liquid nitrogen according to claim 12, said apparatus being placed above the conveyor for the containers, between a station for filling the containers with the product and a station for sealing the containers, and means for synchronizing opening of said actuators with passage of the containers beneath said apparatus.

* * * * *